US010612834B2

(12) United States Patent
Allard et al.

(10) Patent No.: US 10,612,834 B2
(45) Date of Patent: Apr. 7, 2020

(54) METHOD FOR MANUFACTURING AN INSULATED STRUCTURE FOR A REFRIGERATOR

(71) Applicant: WHIRLPOOL CORPORATION, Benton Harbor, MI (US)

(72) Inventors: Paul B. Allard, Coloma, MI (US); Gustavo Frattini, St. Joseph, MI (US); Alberto Regio Gomes, St. Joseph, MI (US); Lynne F. Hunter, Dorr, MI (US); Dustin M. Miller, South Bend, IN (US); Abhay Naik, Stevensville, MI (US); Berhanu Allo, Newburgh, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/312,333

(22) PCT Filed: Jul. 26, 2016

(86) PCT No.: PCT/US2016/043979
§ 371 (c)(1),
(2) Date: Dec. 21, 2018

(87) PCT Pub. No.: WO2018/022006
PCT Pub. Date: Feb. 1, 2018

(65) Prior Publication Data

US 2019/0162465 A1 May 30, 2019

(51) Int. Cl.

| | |
|---|---|
| ***F25D 23/08*** | (2006.01) |
| ***F25D 23/06*** | (2006.01) |
| ***F25D 23/02*** | (2006.01) |

(52) U.S. Cl.
CPC ..... *F25D 23/085* (2013.01); *F25D 23/028* (2013.01); *F25D 23/063* (2013.01); *F25D 23/066* (2013.01); *F25D 2201/14* (2013.01)

(58) Field of Classification Search
CPC .... F25D 23/085; F25D 23/087; F25D 23/082; F25D 23/062; F25D 23/063; F25D 23/064; F25D 23/066; F25D 2201/14
See application file for complete search history.

(56) References Cited

U.S. PATENT DOCUMENTS

| | | | |
|---|---|---|---|
| 2,873,041 | A | 2/1959 | Allen |
| 3,915,328 | A | 10/1975 | Hawes et al. |

(Continued)

FOREIGN PATENT DOCUMENTS

| | | | |
|---|---|---|---|
| DE | 1966725 | U | 8/1967 |
| EP | 0563827 | A2 | 10/1993 |

(Continued)

OTHER PUBLICATIONS

Extended European Search Report, European Application No. 16910684.6, dated Feb. 25, 2020 (7 pages).

*Primary Examiner* — Daniel J Rohrhoff
(74) *Attorney, Agent, or Firm* — Price Heneveld LLP

(57) ABSTRACT

A vacuum insulated refrigerator structure being formed from a wrapper extending around a liner is provided. The liner is positioned inside of the wrapper to form a gap there between, and to form a cavity between the wrapper and the liner. An insulating thermal bridge is formed from molding one or more extruded rails to one or more corner pieces in an injection molding device. The insulating thermal bridge is coupled across the gap wherein the insulating thermal bridge includes elongated first and second channels wherein the first and second edges are inserted into the elongated first and second channels, respectively. A curable sealant is contacted to the elongated first and second channels and the (Continued)

cavity is at least partially filled with a porous material between the wrapper and the liner. A vacuum is formed in the cavity and the cavity is sealed to maintain the vacuum.

20 Claims, 13 Drawing Sheets

(56) References Cited

U.S. PATENT DOCUMENTS

| | | | | |
|---|---|---|---|---|
| 4,732,432 | A | 3/1988 | Keil et al. | |
| 5,269,099 | A | 12/1993 | Kennedy et al. | |
| 5,284,023 | A | 2/1994 | Silva et al. | |
| 5,368,381 | A | 11/1994 | Mandel | |
| 5,876,104 | A | 3/1999 | Kunkel et al. | |
| 5,934,085 | A | 8/1999 | Suzuki et al. | |
| 7,316,125 | B2 | 1/2008 | Uekado et al. | |
| 9,170,046 | B2 * | 10/2015 | Jung | F25D 23/066 |
| 2010/0287974 | A1 | 11/2010 | Cur et al. | |
| 2012/0285971 | A1 | 11/2012 | Junge et al. | |
| 2013/0270732 | A1 | 10/2013 | Wu et al. | |
| 2016/0258671 | A1 * | 9/2016 | Allard | F25D 23/065 |
| 2017/0190081 | A1 * | 7/2017 | Naik | B29C 44/56 |
| 2018/0311889 | A1 * | 11/2018 | Mittendorfer | B32B 7/06 |
| 2019/0120544 | A1 * | 4/2019 | Deka | F25D 23/065 |
| 2019/0128594 | A1 * | 5/2019 | Allard | F25D 23/082 |

FOREIGN PATENT DOCUMENTS

| | | | | |
|---|---|---|---|---|
| WO | 9920961 | | 4/1999 | |
| WO | WO-2018151705 | A1 * | 8/2018 | F16B 11/006 |

* cited by examiner

METHOD FOR MANUFACTURING AN INSULATED STRUCTURE FOR A REFRIGERATOR

FIELD OF THE DISCLOSURE

The present disclosure generally relates to insulated structures, and in particular, to a vacuum insulated refrigerator cabinet structure that includes a thermal bridge breaker that seals and interconnects components of the cabinet structure.

BACKGROUND OF THE DISCLOSURE

Refrigerators and freezers may account for a significant percentage of total residential energy usage. Technological advances in compressors, thermal insulation, heat exchangers, motors, and fans have increased the energy efficiency a refrigerators. Although incremental gains through continuous improvements in component technologies and system optimizations may be possible, the industry needs major technology breakthroughs to meet the ever-challenging energy standards.

Refrigerator cabinets including vacuum insulation panels (VIPs) have been developed. VIPs may include low thermal conductivity core materials that are vacuum sealed in an envelope made of composite barrier films. VIPs may be placed inside cabinet walls with polyurethane foam insulation. Thanks to the advances in the last two decades in barrier films, core materials, and manufacturing technologies, VIP technology is slowly becoming a commercially viable solution for improving the energy efficiency of a refrigerator, even though there are still many problems that must be addressed in order for the insulation technology to reach its fullest potential in the refrigerator and freezer markets.

SUMMARY

According to one aspect of the present disclosure, a method for making a vacuum insulated refrigerator structure is provided. The method includes forming a wrapper from a sheet of material whereby the wrapper has a first opening and a first edge extending around the first opening, forming a liner from a sheet of material whereby the liner has a second opening and a second edge extending around the second opening, positioning the liner inside of the wrapper with the first and second edges being spaced apart to form a gap therebetween, and to form a cavity between the wrapper and the liner, and forming an insulating thermal bridge by molding corner portions onto adjacent end portions of one or more elongated rails in an injection molding device, wherein the insulating thermal bridge includes elongated first and second channels. The method further includes positioning uncured curable sealant in the first and second channels, inserting the first and second edges into the first and second channels, respectively, to couple the insulating thermal bridge across the gap, causing a porous material to at least partially fill the cavity between the wrapper and the liner, forming a vacuum in the cavity, and sealing the cavity to maintain the vacuum.

According to another aspect of the present disclosure, a method of making a vacuum insulated refrigerator structure is provided. The method includes forming a wrapper from a sheet of material whereby the wrapper has a first opening and a first edge extending around the first opening, forming a liner from a sheet of material whereby the liner has a second opening and a second edge extending around the second opening, positioning the liner inside of the wrapper with the first and second edges being spaced apart to form a gap therebetween, and to form a cavity between the wrapper and the liner, and forming a plurality of rails utilizing a co-extrusion process that includes co-extruding a base material and a barrier material to facilitate barrier performance to gases and/or liquids. The method further includes forming an insulating thermal bridge by molding corner portions to end portions of adjacent rails in an injection molding device, wherein the insulating thermal bridge includes elongated first and second channels, coupling the insulating thermal bridge across the gap by inserting the first and second edges into the first and second channels, respectively, positioning a curable sealant in the first and second channels, causing a porous material to at least partially fill the cavity between the wrapper and the liner, forming a vacuum in the cavity, and sealing the cavity to maintain the vacuum.

According to another aspect of the present disclosure, a vacuum insulated refrigerator structure is provided. The vacuum insulated refrigerator includes an outer wrapper having a first opening and a first edge extending around the first opening, a liner having a second opening and a second edge extending around the second opening, wherein the liner is disposed inside the wrapper with the first and second edges being spaced apart to form a gap therebetween and to form a vacuum cavity between the wrapper and the liner, an insulating thermal bridge extending across the gap, wherein the insulating thermal bridge includes elongated first and second channels, wherein at least one of the elongated first and second channels includes one or more flexible locators protruding into the elongated first and/or second channels from both channel walls, and wherein the first and second edges are disposed in the first and second channels, respectively, a sealant disposed in the first and second channels to seal the vacuum cavity and maintain a vacuum in the vacuum cavity, and a porous material disposed in the vacuum cavity.

These and other features, advantages, and objects of the present device and method will be further understood and appreciated by those skilled in the art upon studying the following specification, claims, and appended drawings.

DETAILED DESCRIPTION OF EMBODIMENTS

Figure 1:
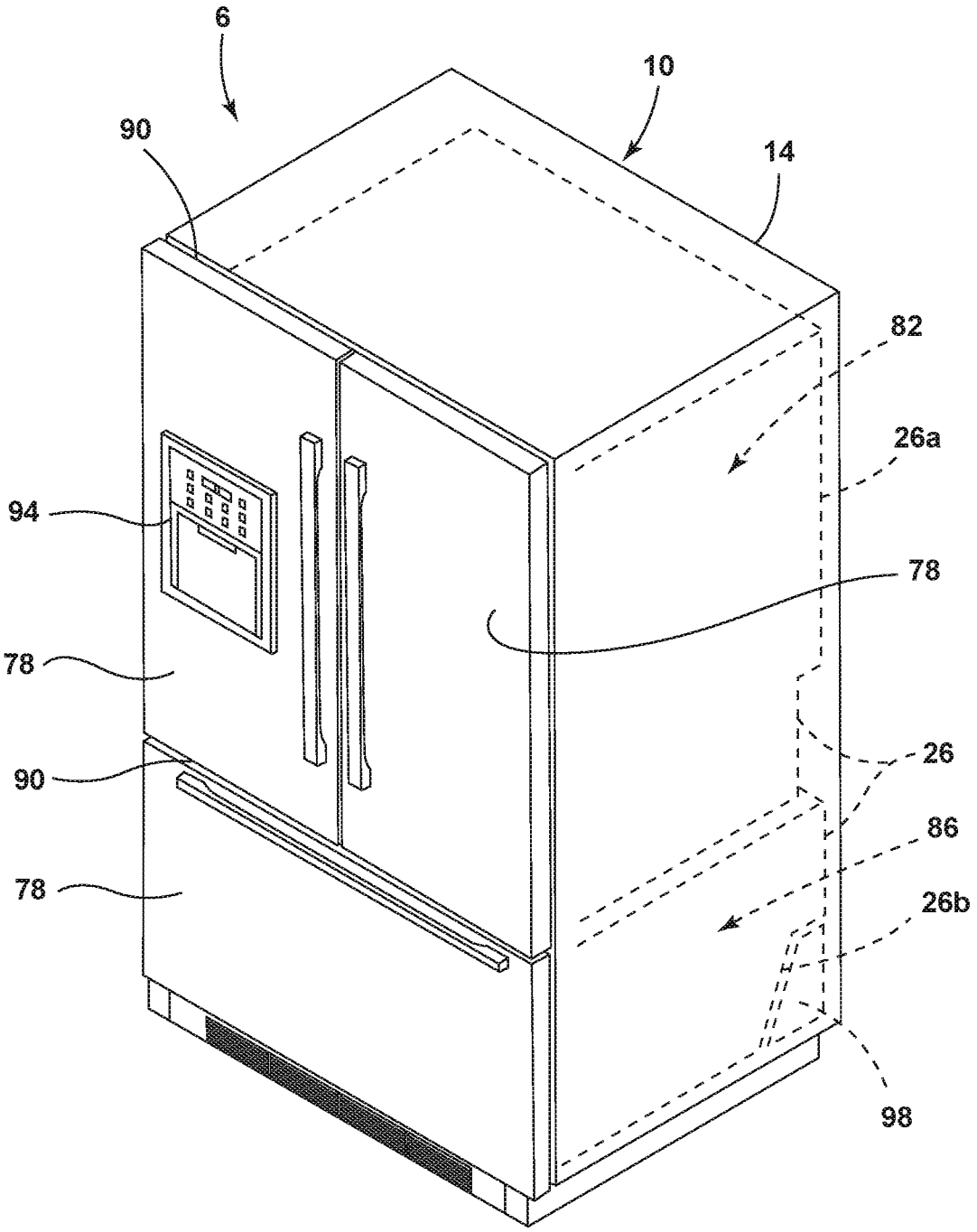
FIG. 1 is a front isometric view of a refrigerator including a vacuum insulated cabinet structure according to one aspect of the present disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present application is related to Application No. PCT/US16/43991, entitled "THERMAL BRIDGE-BREAKER AND SEAL FEATURES IN A THIN-WALLED VACUUM INSULATED STRUCTURE," filed on even date herewith, and Application No. PCT/US16/43983, entitled "VACUUM INSULATED STRUCTURE TRIM BREAKER," filed on even date herewith. The entire contents of each of these applications are incorporated herein by reference.

As used herein, the term "and/or," wherein used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIG. 1-16, a refrigerator 6 includes a vacuum insulated refrigerator structure 10 having a wrapper 14, a liner 26, and a thermal bridge 46 that interconnects wrapper 14 and liner 26. Wrapper 14 is formed to have a first opening 18 and a first edge 22 extending around the first opening 18. Liner 26 is formed to include a second opening 30 and a second edge 34 extending around the second opening 30. During assembly, the liner 26 is positioned inside of the wrapper 14 with the first and second edges 22, 34, respectively, being spaced apart to form a gap 38 there between, and to form a cavity 42 between the wrapper 14 and the liner 26. Insulating thermal bridge 46 is formed by molding one or more extruded rails 50 to one or more corner portions or pieces 54 in an injection molding device 58. Insulating thermal bridge 46 includes an elongated first channel 62 and an elongated second channel 66. During assembly, the first and second edges 22, 34 of the wrapper 14 and the liner 26, respectively, are inserted into the elongated first and second channels 62, 66, respectively, whereby the insulating thermal bridge 46 is coupled to wrapper 14 and liner 26 and extends across gap 38. As discussed in more detail below in connection with FIGS. 12-12A and 13-13A, during assembly curable sealant 70 is contacted to (e.g. injected into) the elongated first and second channels 62, 66 and the cavity 42 between wrapper 14 and liner 26 is at least partially filled with a porous material 74. A vacuum is formed in the cavity 42 and the cavity 42 is sealed to maintain the vacuum.

Referring now to FIG. 1, the liner 26 may comprise a single, one-piece liner, or the liner 26 may comprise two or more components such as a refrigerator liner 26*a* and a freezer liner 26*b*. The vacuum insulated refrigerator structure 10 depicted in FIG. 1 is a French door bottom mount refrigerator, but it will be understood that this disclosure may equally be applied to freezers, walk in coolers and the like, without departing from the teachings provided herein. The vacuum insulated refrigerator structure 10 may include one or more appliance doors 78 which may be opened to allow users of the vacuum insulated refrigerator structure 10 to place and remove items from within the refrigerator compartment 82 and/or the freezer compartment 86 through one or more access openings 90. Appliance doors 78 may be closed to close off openings 90. The appliance doors 78 may optionally include an ice and/or water dispenser 94.

A refrigeration system 98 cools the refrigerator compartment 82 and/or the freezer compartment 86. The refrigeration system 98 may comprise a known system including a compressor, condenser, expansion valve, evaporator, conduits, and other related components (not shown). Alternatively, the refrigeration system 98 may comprise thermoelectric components (not shown), or other suitable arrangements depending on the use.

Figure 2:
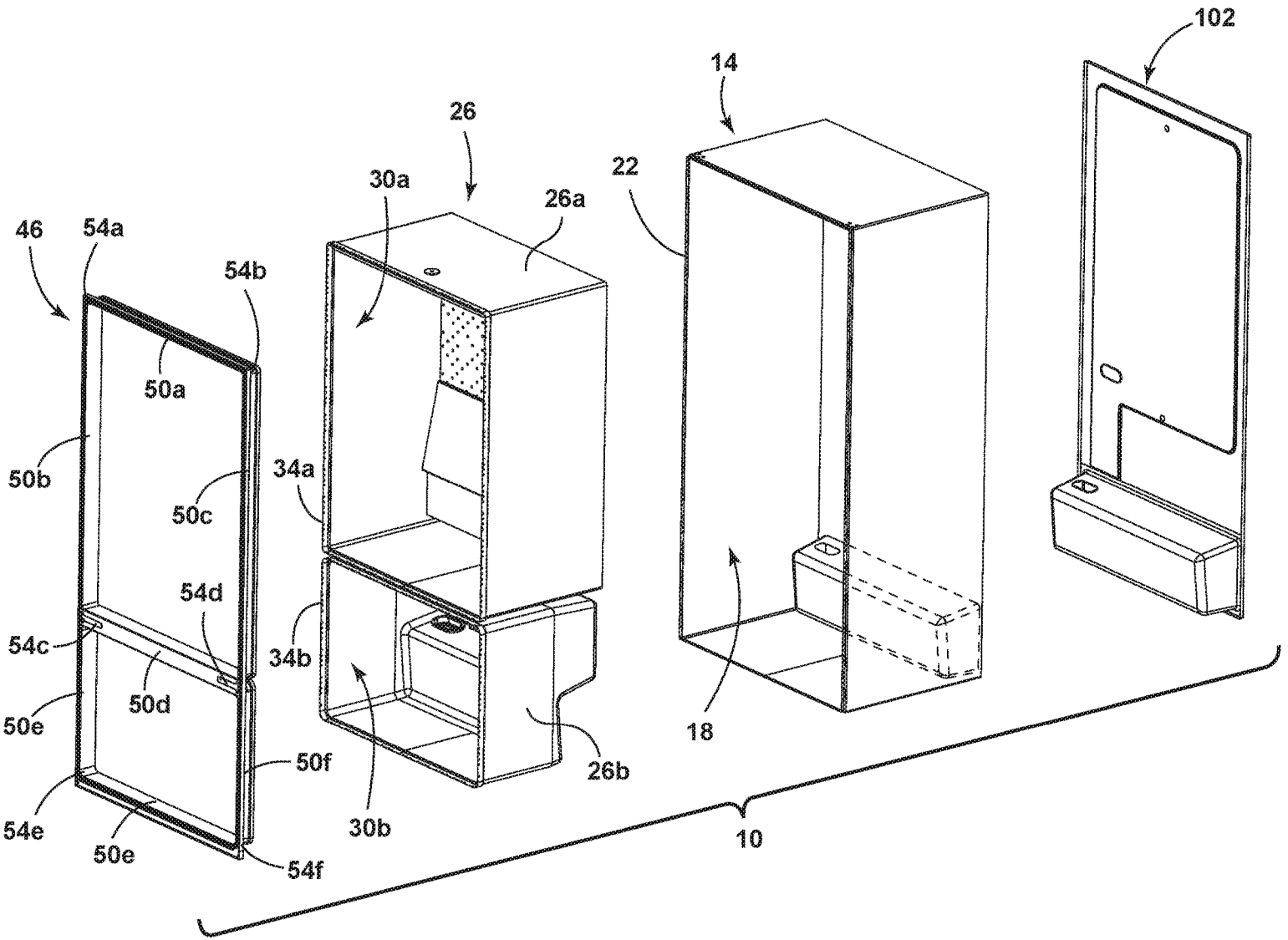
FIG. 2 is an exploded side isometric view of the refrigeration structure according to one aspect of the present disclosure.

Referring now to FIG. 2, the vacuum insulated refrigerator structure 10 may include a back cover 102 that is coupled to the wrapper 14. When assembled (FIG. 1), the liners 26, both a refrigerator liner 26*a* and a freezer liner 26*b* are disposed in the wrapper 14 therein. The wrapper 14 and the liner 26 (or liners 26*a* and 26*b*) are coupled to the insulating thermal bridge 46. The wrapper 14 is connected to the insulating thermal bridge 46 at the first edge 22. As discussed above, the first edge 22 extends around/surrounds the first opening 18 of the wrapper 14. Refrigerator liner 26*a* and the freezer liner 26*b* include second edges 34*a* and 34*b*, respectively, surrounding second openings 30*a* and 30*b*, respectively. The second edges 34*a* and 34*b* are coupled to the insulating thermal bridge 46. As discussed in more detail below in connection with FIG. 6, the insulating thermal bridge 46 is made of both corner pieces 54*a*-54*f* and extruded rail pieces 50*a*-50*g* that are molded together to form the insulating thermal bridge 46.

Figure 3:
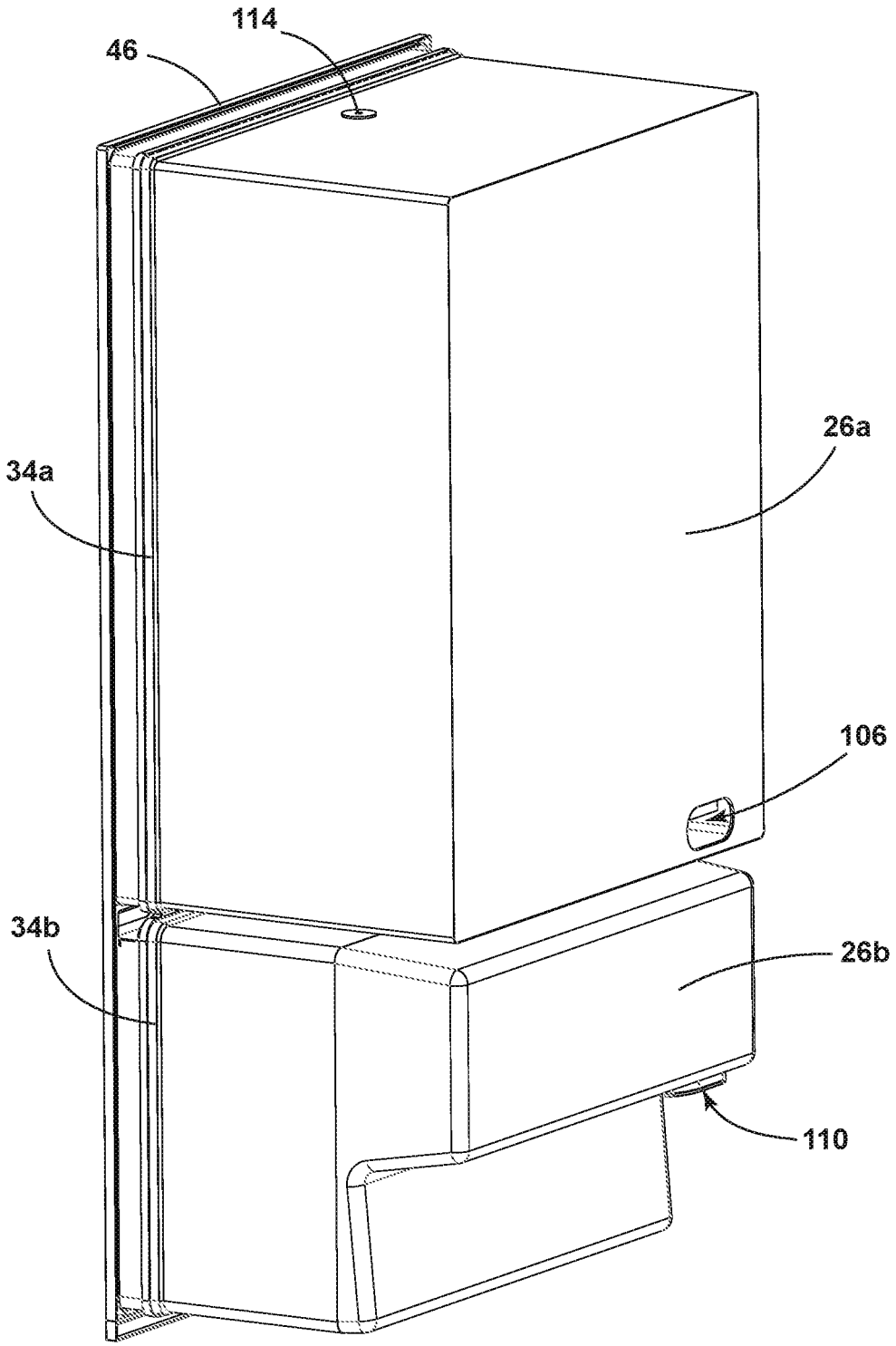
FIG. 3 is a rear side isometric view of a refrigerator liner and a freezer liner attached to an insulating thermal bridge according to one aspect of the present disclosure.

Referring now to FIG. 3, the refrigerator liner 26*a* and the freezer liner 26*b* are coupled to the insulating thermal bridge 46 at the second edges 34*a* and 34*b* (see also FIG. 2). The refrigerator liner 26*a* may include a refrigerator pass through opening 106 and the freezer liner 26*b* may include a freezer pass through opening 110. Both the refrigerator pass through opening 106 and the freezer pass through opening 110 can be used to pass electrical lines, water lines, and/or refrigeration lines, as needed for the application. In some embodiments, a vacuum port 114 may be positioned in the refrigerator liner 26*a* in order to evacuate the cavity 42 (FIG. 5) having a vacuum core material 118 (FIG. 5).

Figure 4:
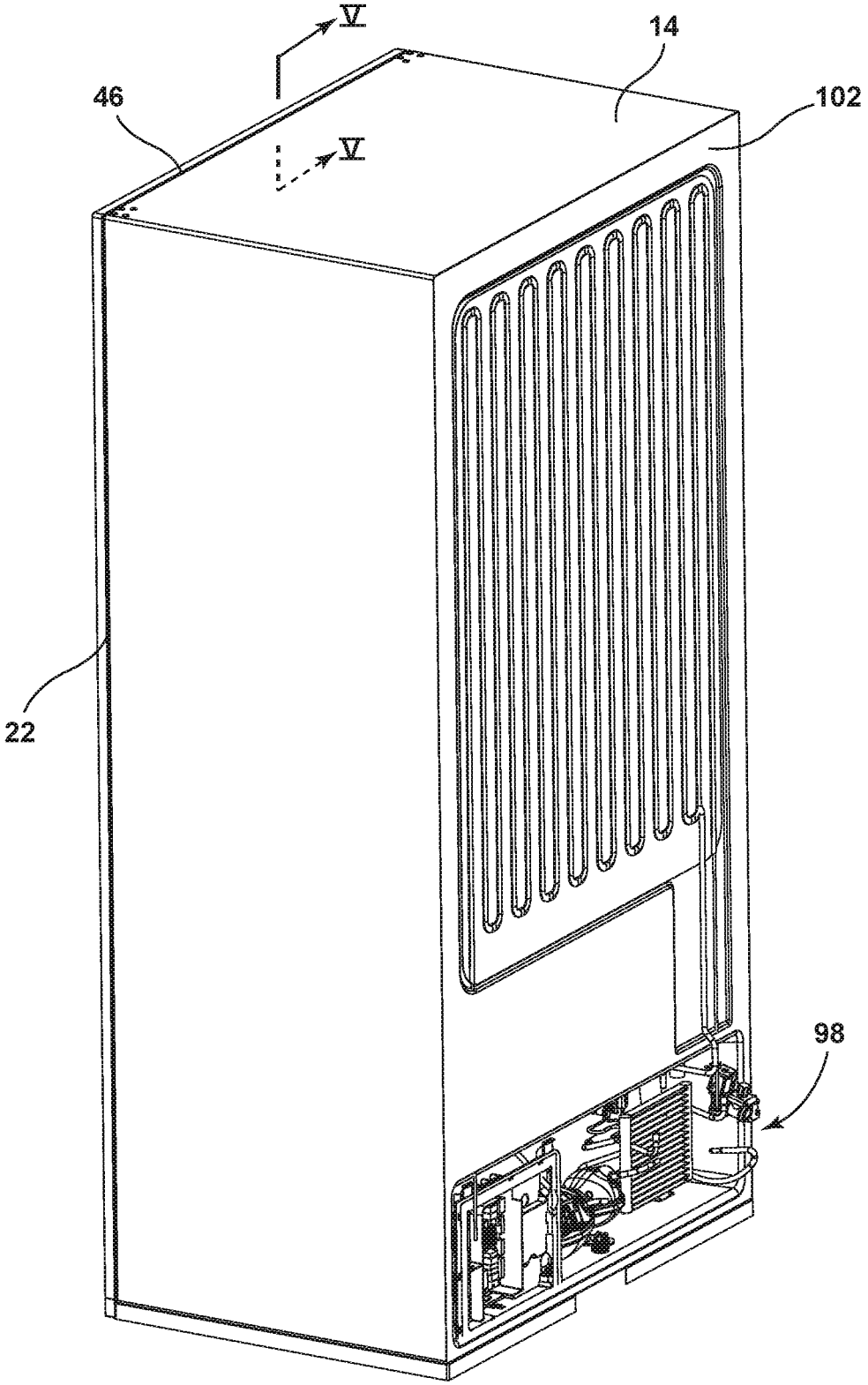
FIG. 4 is a rear isometric view of the vacuum insulated structure according to one aspect of the present disclosure.

Referring now to FIG. 4, when assembled back cover 102 is coupled to wrapper 14, and wrapper 14 is coupled to the insulating thermal bridge 46 through the first edge 22 (FIG. 2). The components of the refrigeration system 98 such as the compressor, condenser, and other related components may be usable through the bottom portion of the back cover 102.

Figure 5:
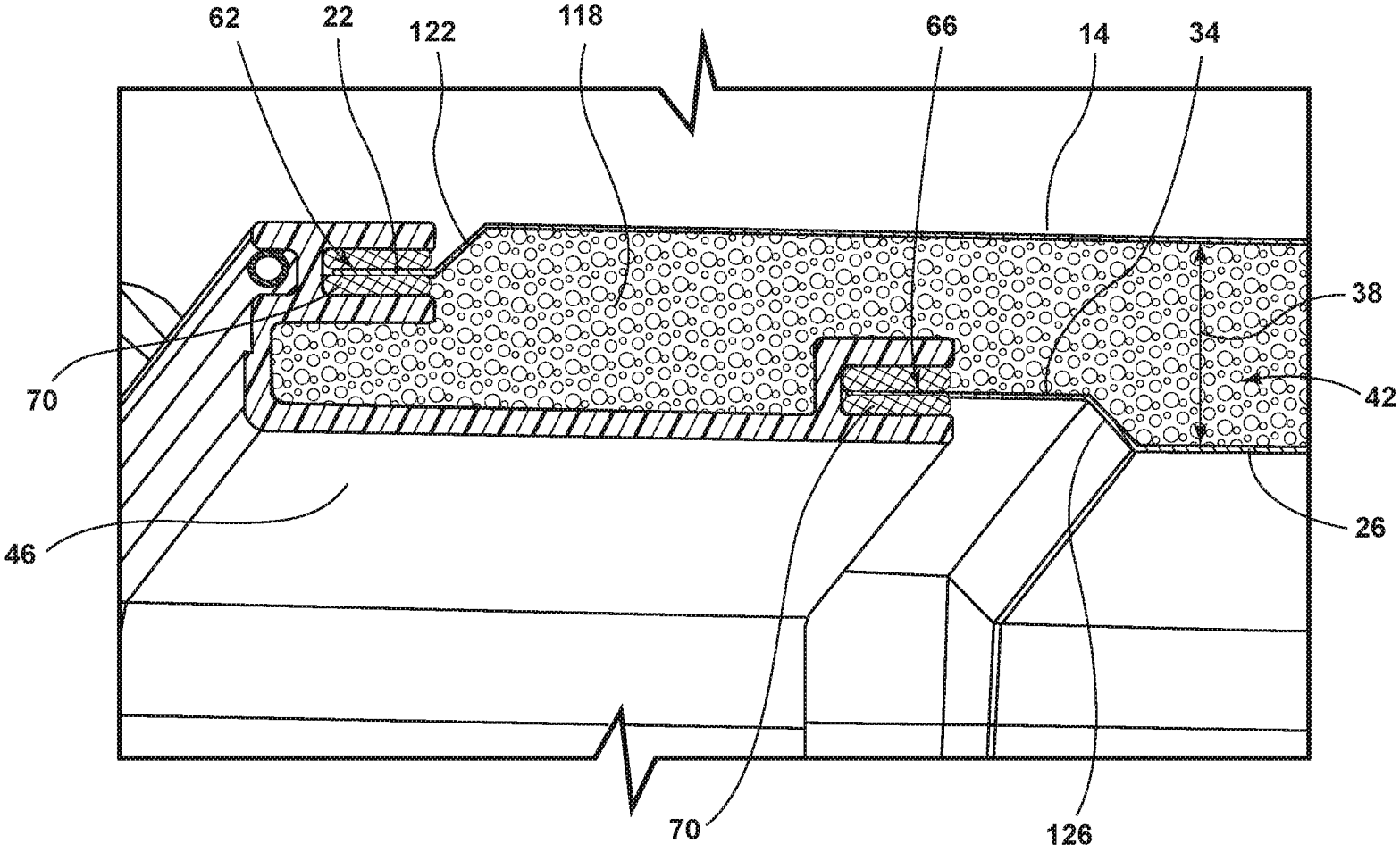
FIG. 5 is a partially schematic fragmentary cross-sectional view of a portion of the vacuum insulated structure of FIG. 4 taken along the line V-V.

Referring now to FIG. 5, the insulating thermal bridge 46 couples or interconnects the wrapper 14 and the liner 26 when assembled. The wrapper 14, the liner 26, and the insulating thermal bridge 46 define vacuum cavity 42 which is substantially filled with the vacuum core material 118. The vacuum core material 118 may comprise a plurality of pre-formed individual vacuum core panels that are positioned in the cavity 42 between the wrapper 14, the liner 26, and the insulating thermal bridge 46. If pre-formed vacuum core panels are utilized, the core panels may be positioned between wrapper 14 and liners 26*a*, 26*b* at the time the liners 26*a*, 26*b* are inserted into wrapper 14 (i.e. before thermal bridge 46 is connected to wrapper 14 and liners 26*a*, 26*b*). Alternatively, in some embodiments, the vacuum core material 118 may comprise silica powder or other suitable loose filler material that is inserted (e.g., blown) into the cavity 42.

The wrapper 14 may be formed from a sheet metal, a thermoplastic polymer, or any other suitable material. The wrapper 14 includes an angled wrapper flange 122 that transitions into the first edge 22. The liner 26 includes an angled liner flange 126 that transitions into the second edge 34. The insulating thermal bridge 46 couples the first edge 22 of the wrapper 14 with the second edge 34 of the liner 26 to thereby interconnect the wrapper 14 and liner 26 to close off gap 38. Gap 38 corresponds to the distance between the wrapper 14 and liner 26. The insulating thermal bridge 46 is preferably formed from a suitable material (e.g., a polymer such as Polyvinyl Chloride (PVC) or Poly Butylene Terephthalate (PBT)) having a lower coefficient of thermal conductivity to reduce or prevent transfer of heat between the wrapper 14 and the liner 26. The polymer material of thermal bridge 46 may also be substantially impermeable to atmospheric gasses (e.g. oxygen, nitrogen, carbon dioxide, water vapor, etc. to ensure that a vacuum is maintained in space 42. When the vacuum insulated refrigerator structure 10 is in use, the wrapper 14 is typically exposed to room temperature air, whereas the liner 26 is generally exposed to refrigerator air in the refrigerator compartment 82 or freezer compartment 86. Because the insulating thermal bridge 46 is made of a material that is substantially non-conductive with respect to heat, the insulating thermal bridge 46 reduces transfer of heat from the wrapper 14 to the liner 26. During assembly, the first edge 22 of the wrapper 14 is positioned within the elongated first channel 62 and the second edge 34 (or edges 34*a* and 34*b*) of the liner 26 is positioned within the elongated second channel 66.

Examples of layered polymer materials that may be utilized to construct the wrapper 14 and/or the liner 26 are disclosed in U.S. patent application Ser. No. 14/980,702, entitled "MULTI-LAYER BARRIER MATERIALS WITH PVD OR PLASMA COATING FOR VACUUM INSULATED STRUCTURE," filed on Dec. 28, 2015, and U.S. patent application Ser. No. 14/980,778, entitled "MULTI-LAYER GAS BARRIER MATERIALS FOR VACUUM INSULATED STRUCTURE," filed on Dec. 28, 2015, the entire contents of which are incorporated by reference. Specifically, the wrapper 14 and/or liner 26 may be thermoformed from a tri-layer sheet of polymer material, comprising first and second outer layers and a central barrier layer that is disposed between the outer layers. The outer layers and the barrier layer may comprise thermoplastic polymers. The barrier layer may optionally comprise an elastomeric material. The outer layers and the barrier layer may be coextruded or laminated together to form a single multi-layer sheet prior to thermoforming. The outer structural layers may comprise a suitable thermoplastic polymer material such as High Impact Polystyrene (HIPS) or Acrylonitrile, Butadiene and Styrene (ABS), Polypropylene or Poly Butylene Teraphthalate or Polyethylene. The barrier layer may comprise a thermoplastic polymer material that is impervious to one or more gasses such as nitrogen, oxygen, water vapor, carbon dioxide, etc. such that the wrapper and/or liner 14 and 26, respectively, provide a barrier to permit forming a vacuum in interior space 42. The barrier layer preferably comprises a material that blocks both oxygen and water vapor simultaneously. Examples include Polyvinylidene Chloride (PVdC), high barrier nylon, or liquid crystal polymer. The thickness of the barrier layer may be adjusted as required for different applications to meet varied requirements with respect to oxygen and water vapor transmission rates. The materials are selected to have very good thermoforming properties to permit deep draw ratio thermoforming of components such as wrapper 14 and liner 26 and other vacuum insulated refrigerator structures. Typically, the outer layers have a thickness of about 0.1 mm to 10 mm, and the barrier layer(s) have a thickness of about 0.1 mm to 10 mm.

The following are examples of material combinations that may be utilized to form a tri-layer sheet of material that may be thermoformed to fabricate wrapper 14 and/or liner 26:

Example 1: HIPS/PVdC/HIPS
Example 2: HIPS/Nylon/HIPS
Example 3: HIPS/MXD-6 Nylon/HIPS
Example 4: HIPS/MXD-6 Nylon with clay filler/HIPS
Example 5: HIPS/Liquid Crystal Polymer/HIPS A quad-layer sheet having first and second outer layers and two barrier layers may also be utilized to form wrapper 14 and/or liner 26. The outer layers may comprise HIPS, ABS, or other suitable polymer material (e.g. Polypropylene of Poly Butylene Teraphthalate or Polyethylene) that is capable of being thermoformed. The first barrier layer may comprise a thermoplastic polymer material that is substantially impervious to water vapor. Examples of thermoplastic polymer or elastomeric materials for the first barrier layer include fluoropolymer such as Tetrafluoroethylene (THV), polychlorotrifluoroethylene (PCTFE), Cyclic Olefin Copolymer (COC), Cyclic Olefin Polymer (COP), or high density polyethylene (HDPE). The second barrier layer may comprise a thermoplastic polymer that is substantially impervious to oxygen. Examples of thermoplastic polymer materials include ethylene vinyl alcohol EVOH. An optional tying layer comprising a thermoplastic polymer material may be disposed between the two barrier layers. The optional tie layer may be utilized to bond the two barrier layers to one another. Examples of suitable materials for the tie layer include adhesive resins, such as modified polyolefin with functional groups that are capable of bonding to a variety of polymers and metals.

The following are examples of material combinations that may be utilized to form a quad-layer sheet:

Example 1: HIPS/EVOH/HDPE/HIPS
Example 2: HIPS/EVOH/COP/HIPS
Example 3: HIPS/EVOH/COC/HIPS
Example 4: HIPS/EVOH/THV/HIPS THV
Example 5: HIPS/EVOH/PCTFE/HIPS The four layers may be coextruded or laminated together to form a single sheet of material prior to thermoforming to fabricate wrapper 14 and/or liner 26.

Figure 6:
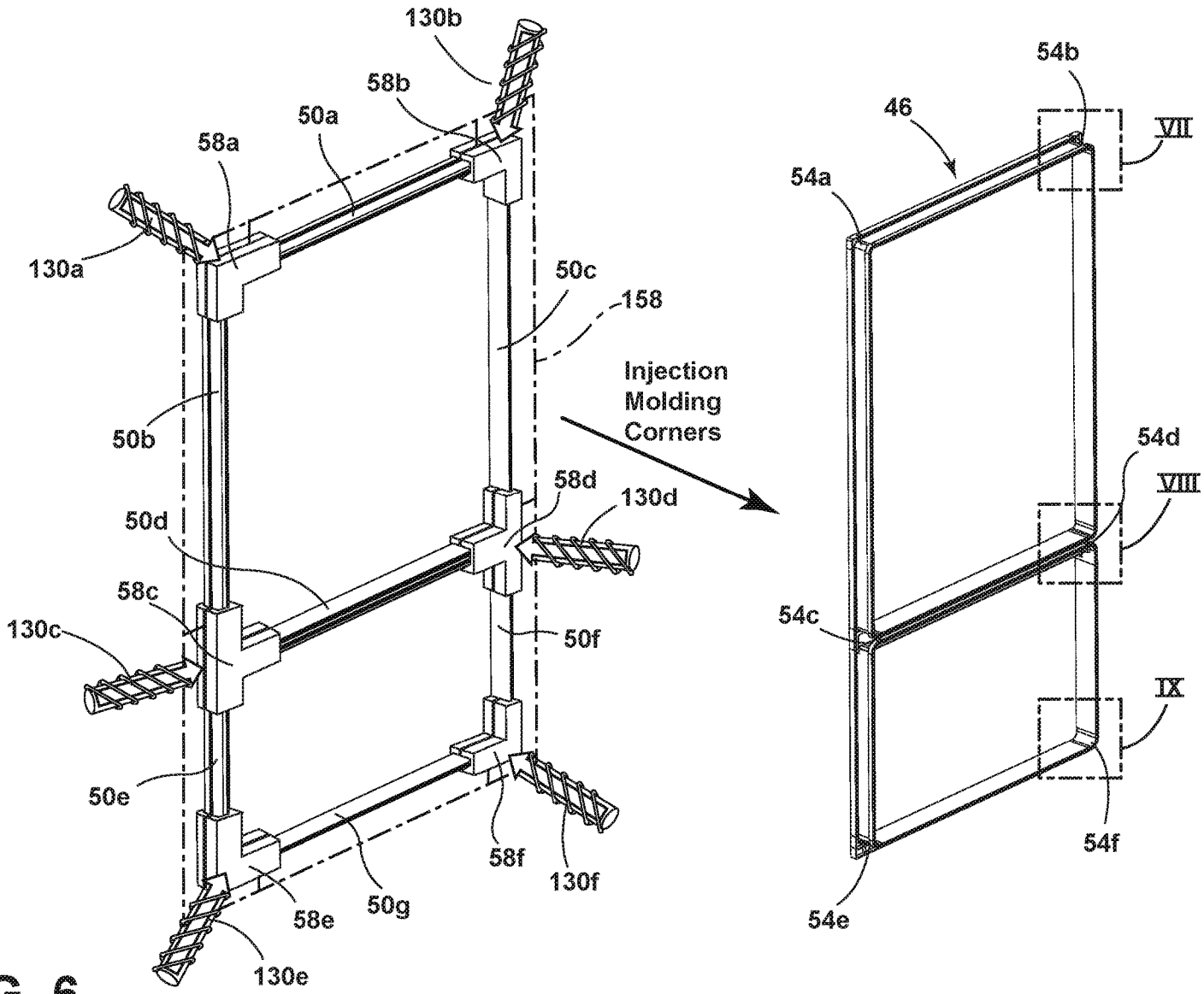
FIG. 6 is a partially schematic isometric view showing fabrication of an insulating thermal bridge.
Figure 6A:
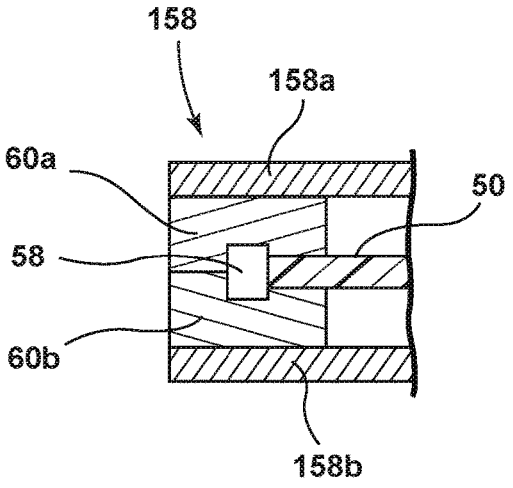
FIG. 6A is a partially schematic fragmentary cross-sectional view of a closed portion of a mold cavity in the mold tool of FIG. 6 according to one aspect of the present disclosure.
Figure 6B:
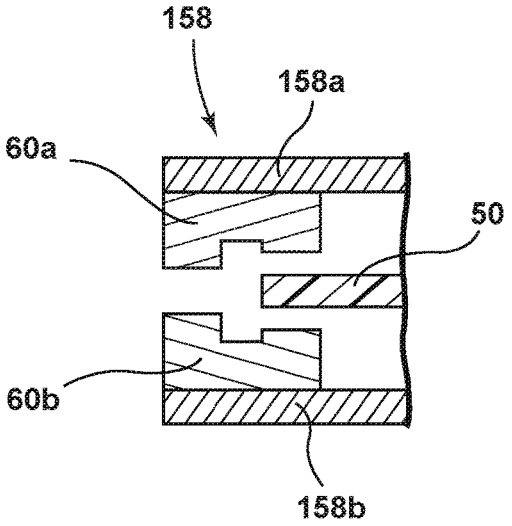
FIG. 6B is a is a partially schematic fragmentary cross-sectional view of an open portion of a mold cavity in the mold tool of FIG. 6 according to one aspect of the present disclosure.
Figure 6C:
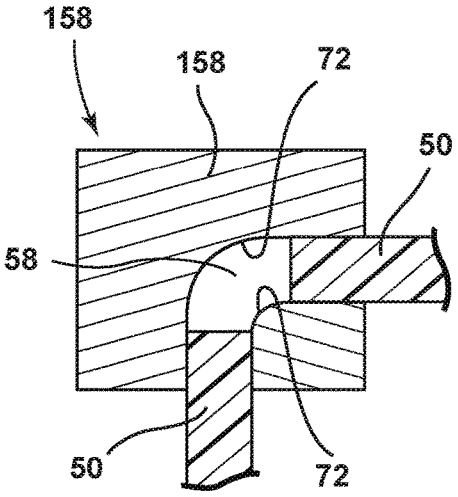
FIG. 6C is a partially schematic fragmentary cross-sectional top view of a portion of a mold cavity in the mold tool of FIG. 6 according to one aspect of the present disclosure.
Figure 6D:
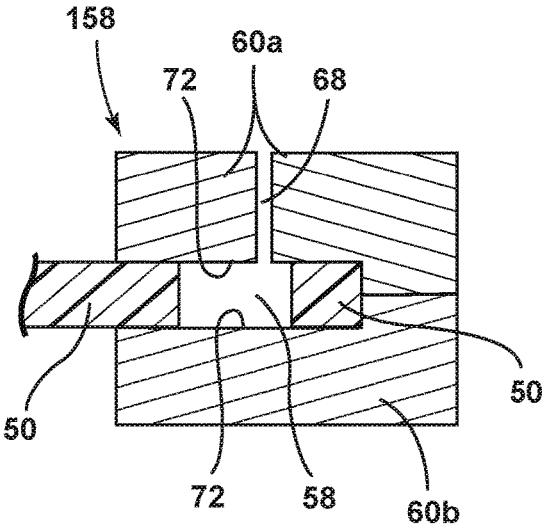
FIG. 6D is a is a partially schematic fragmentary cross-sectional side view of a portion of a mold cavity in the mold tool of FIG. 6 according to one aspect of the present disclosure.

Referring now to FIG. 6, a method for combining/interconnecting extruded side rails 50 with injection molded corners 54 to form thermal bridge 46 is shown. With this two part process, the linear side portions 50*a*-50*g* of the insulating thermal bridge 46 can be extruded as straight segments referred to herein as the extruded rails 50. In the second part of this process, the extruded rails 50 are inserted into a tool 158 that supports (e.g. clamps) the extruded rails 50 in position, and injection screws 130*a*-130*f* inject molten polymer material into mold cavities 58*a*-58*f* to thereby mold corner pieces 54 onto the ends of extruded rails 50*a*-50*g*. In some embodiments, where there is a refrigerator compartment 82 and a freezer compartment 86 with a mullion separating these two compartments 82, 86, a variety of differently-shaped injected corners 54 and extruded side rails 50 are required to make the insulating thermal bridge 46. For example, in FIG. 6 five different injection molded corner pieces 54 are utilized: left and right top corners 54*a*, 54*b* may be substantially identical; a right mullion corner piece 54*c*; a left mullion corner piece 54*d*; a right bottom corner piece 54*e*; and a left bottom piece 54*f*.

As also shown in FIG. 6, the extruded rails 50 may have three or more different shapes and/or three or more different lengths. Regarding the three different shapes: the first shape can be used for each the top refrigerator extruded rail 50*a*, the right and left side refrigerator extruded rails 50*b*, 50*c*, and the right and left side freezer extruded rails 50*e*, 50*f*, respectively; the second shape may be utilized for the mullion extruded rail 50*d*; and the third shape may be used for the bottom freezer extruded rail 50*g*. Regarding the three different lengths: each of the horizontal rails may have the same length, specifically, the top rail 50*a*, the mullion rail 50*d*, and the bottom rail 50*g* may have the same length. Right side rail 50*b* and left side rail 50*c* may have the second length and right side rail 50*e* and left side rail 50*f* may have the third length. During fabrication of thermal bridge 46, the opposite ends of each extruded rail 50*a*-50*g* are positioned in mold cavities 58*a*-58*f*, and tool 158 is used to support rails 50*a*-50*g* in position. Tool 158 may comprise a fixture or the like including support/locating surfaces and clamps (not shown) that rigidly support and locate rails 50*a*-50*g*. The injection screws 130*a*-130*f* inject molten thermoplastic polymer material into mold cavities 58*a*-58*f* to mold corners 54*a*-54*f* and join the extruded rails 50*a*-50*g* to form a single insulating thermal bridge 46 piece or component. In some embodiments, the insulating thermal bridge 46 has no seams between the corner pieces 54*a*-54*f*, and the extruded rails 50*a*-50*g*, and thermal bridge 46 therefore appears to be a single piece. The corner pieces 54*a*-54*f* may be molded of the same polymer material (or materials) as rails 50*a*-50*g*. In some embodiments, the rails 50 may all have the same shape and may be coupled/interconnected with four or more corners 54 with the same or different shapes.

Referring now to FIGS. 6A-6D, the tool 158 may have an upper tool structure 158*a* and a lower tool structure 158*b* that can open and close together. An upper mold half 60*a* and a lower mold half 60*b* may support (e.g. clamp) the extruded rails 50 in position, and injection screws 130*a*-130*f* (FIG. 6) inject molten polymer material through a passageway 68 into the mold cavities 58 along a mold surface 72 to thereby mold corner pieces 54 onto the ends of extruded rails 50. In some embodiments, the corner pieces 54 may be molded/coupled to the extruded rails 50 one corner at a time. In other embodiments, the corner pieces 54 may be molded/coupled to the extruded rails 50 one or more at the same time to produce the insulating thermal bridge 46. In still other embodiments, all of the corner pieces 54 may be molded/coupled to the extruded rails 50 at the same time in the same tool 158 to form the insulating thermal bridge 46.

Figure 7:
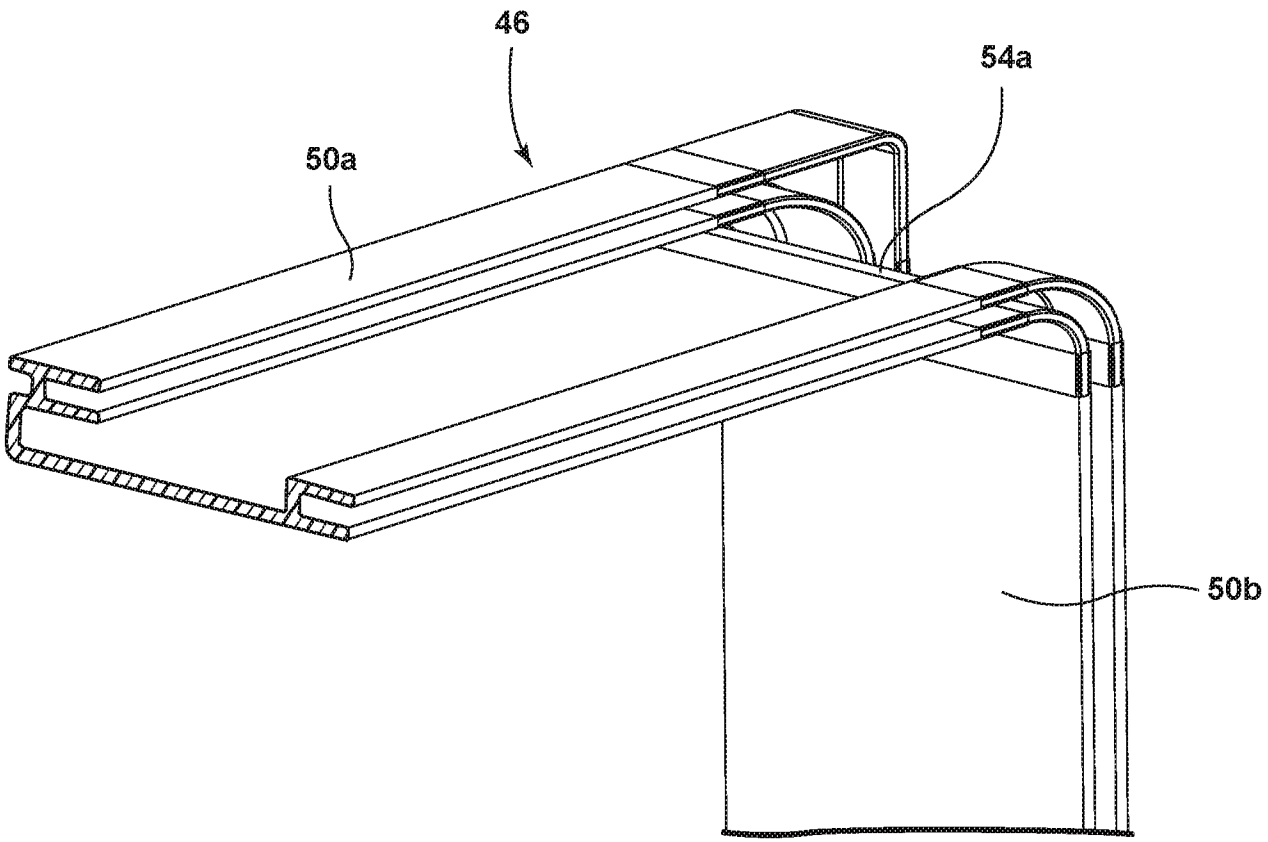
FIG. 7 is a partially fragmentary isometric view of a top corner portion of the insulating thermal bridge of FIG. 6.
Figure 8:
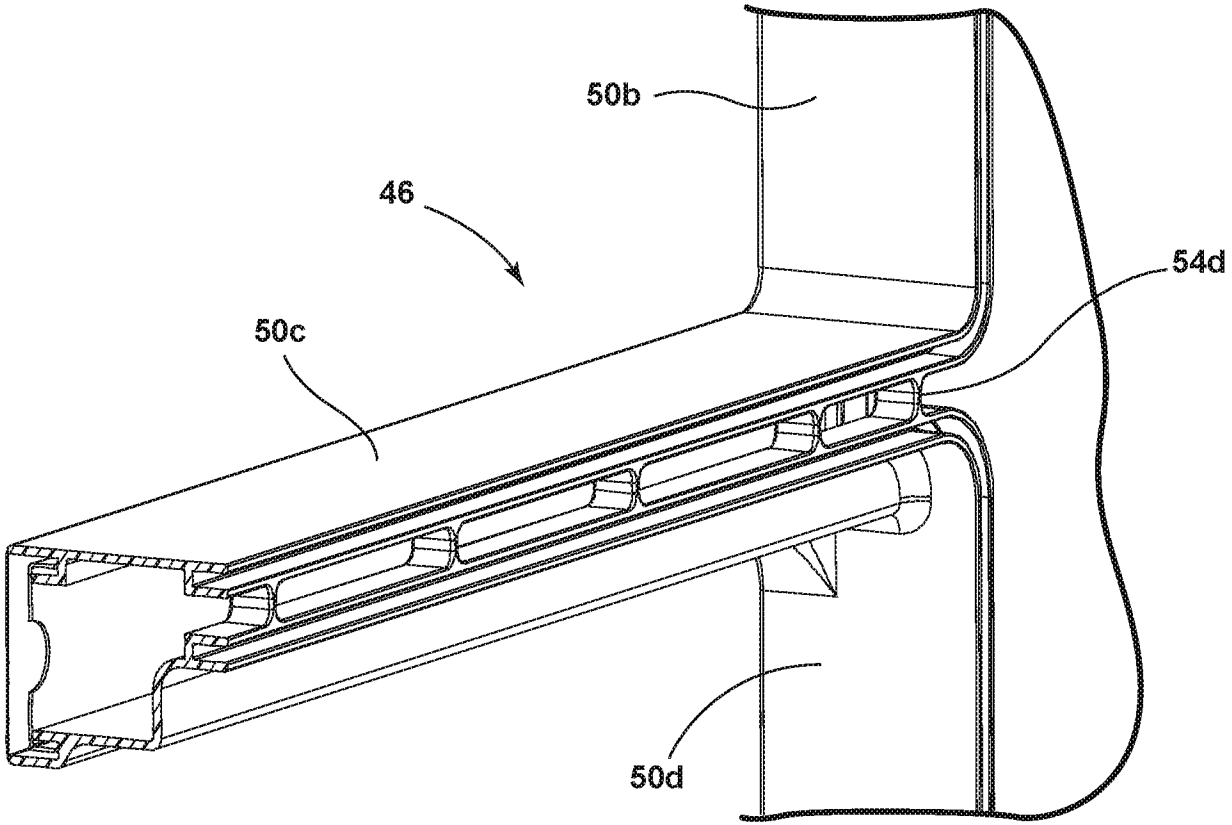
FIG. 8 is a partially fragmentary isometric view of a left mullion corner of the insulating thermal bridge of FIG. 6.
Figure 9:
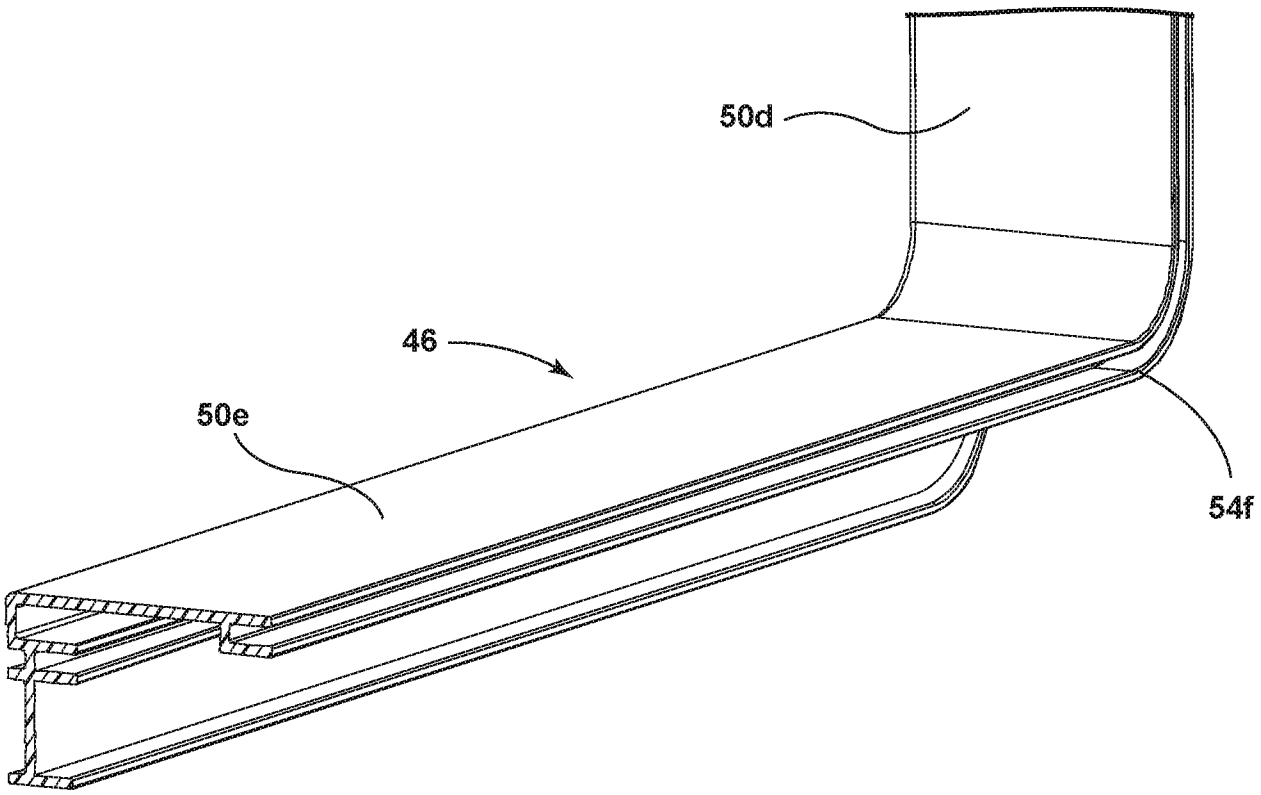
FIG. 9 is a partially fragmentary isometric view of a bottom corner portion of the insulating thermal bridge of FIG. 6.

Referring now to FIGS. 7-9, FIG. 7 shows the top corner 54*a* of the insulating thermal bridge 46 coupled to side rail 50*b* and top rail 50*a* as a single molded piece. It will be understood that top corner 54*a* may be a mirror image of corner 54*b*. FIG. 8 shows the left mullion corner 54*d* of the insulating thermal bridge 46 coupled to the mullion rail 50*d*, the side rail 50*c*, and side rail 50*f*. Lastly, FIG. 9 shows the left bottom corner 54*f* of the insulating thermal bridge 46 coupled to side rail 50*f* and bottom rail 50*g*.

Figure 10:
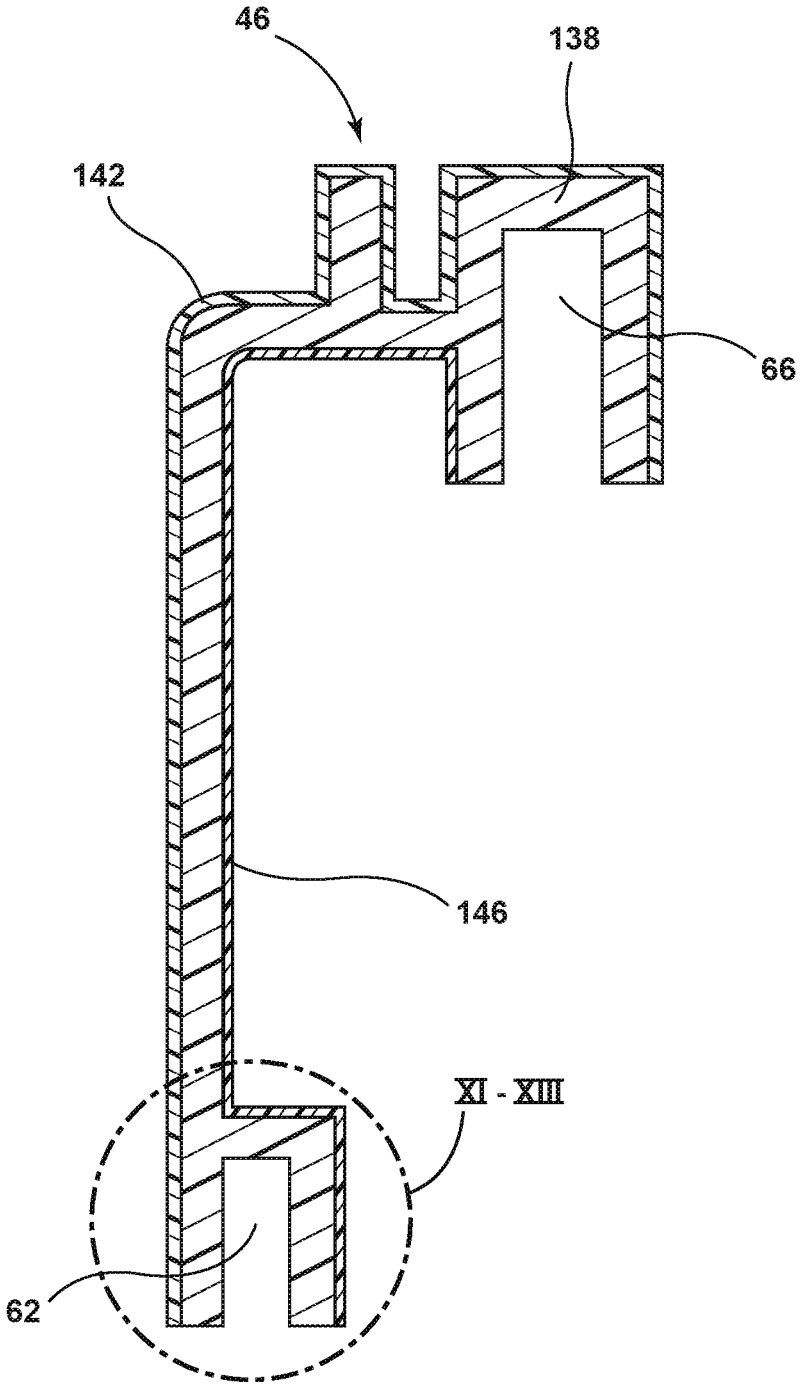
FIG. 10 is a partially schematic cross-sectional view of an extruded rail of an insulating thermal bridge according to one aspect of the present disclosure.

Referring now to FIG. 10, an extruded rail 50 may comprise a core or base material 138 that is at least partially covered with outer barrier materials 142 and/or 146 that are coextruded with the base material 138. Base material 138 may be coupled with an outer barrier material 142 and/or inner barrier material 146 by the coextrusion process. Materials 142 and/or 146 provide a barrier that is substantially impermeable to gas and/or liquids. The base material 138 of rails 50 may comprise one or more of high density polyethylene, polyethylene, linear low density polyethylene, nylon or other suitable material having high barrier properties with respect to gasses and liquids. The extruded rails 50 can also be co-extruded with a barrier material 142 and/or 146 such as ethylene vinyl alcohol (EVOH). Extruded rails 50 may be formed by coextruding the base material 138 and the inner and/or outer barrier material 142 and/or 146 to assist barrier performance (i.e. reduce permeability) with respect to gases and liquids. Inner and/or outer barrier materials 142, 146 may comprise extruded ethylene vinyl alcohol or a combination of ethylene vinyl alcohol and another thermoplastic polymer. In some embodiments, the permeation rate for oxygen through the insulating thermal bridge 46 is less than 10 $cc/m^2 \cdot day \cdot atm$. In some embodiments, the permeation rate for water vapor through the insulating thermal bridge 46 is less than 10 $grams/m^2 \cdot day \cdot atm$, but may be greater. In some embodiments, the heat deflection temperature for the insulating thermal bridge 46 should be a minimum of 160° F. In other embodiments, other desired properties for the insulating thermal bridge 46 would be a coefficient of linear thermal expansion (CLTE) of $4.0 \times 10_5$; a max strain of greater than 6; a maximum stress of 1 MPa; and a flame rating of HB or better. However, it will be understood that the present disclosure is not limited to the material properties described above. As shown in the embodiment of FIG. 10, the insulating thermal bridge 46 may have one or more different designs having the elongated first channel 62 and the elongated second channel 66.

As discussed above, rails 50 may comprise linear members having a substantially uniform cross-sectional shape along the length of the rail 50, and rails 50 may be formed utilizing an extrusion process. However, it will be understood that rails 50 could be formed utilizing molding processes, and could have non-linear configurations and/or non-uniform cross-sectional shapes.

Figure 11:
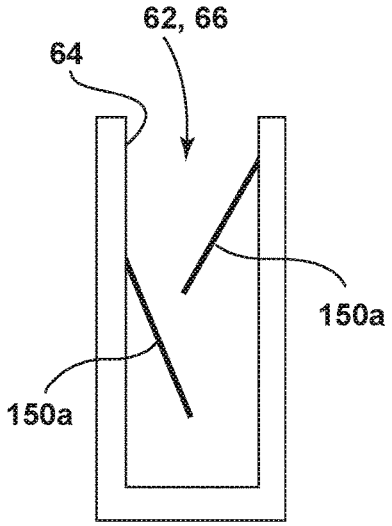
FIG. 11-11B is a partially schematic cross-sectional view of a portion of FIG. 10 having flexible locators according to one aspect of the present disclosure.
Figure 11A:
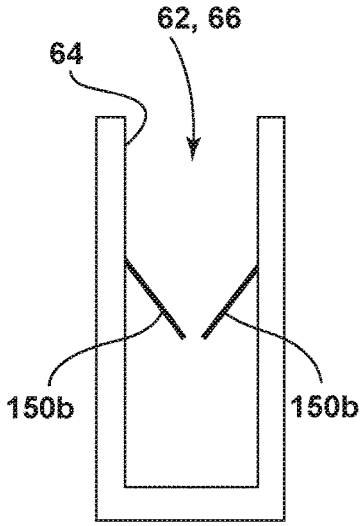
Figure 11B:
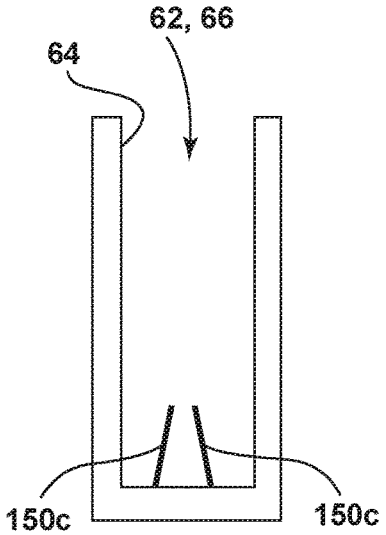

With reference to FIG. 11, rails 50 and/or corners 54 may include flexible locators 150*a* that are located in elongated channels 62 and/or 66. As discussed in more detail below, flexible locators 150 position/guide edges 22 and/or 34 of the wrapper 14 and liner 26 in channels 62 and/or 66 of thermal bridge 46. Alternative configurations 105*b* and 150*c* of the flexible locators are shown in FIGS. 11A and 11B, respectively. It will be understood that "flexible locators 150" as used herein generally refers to any of the flexible locators 150*a*, 150*b*, 150*c*. In some embodiments, rails 50 may be co-extruded with one or more flexible locators 150 extending into the first and/or second elongated channel 62, 66 from at least one channel wall 64. The flexible locators 150 can be provided in the elongated first channel 62 and/or the elongated second channel 66, or in no channel at all. Channels 62 and 66 may have substantially the same size and configuration. The flexible locators 150 can be placed asymmetrically on an elongated channel wall 64 to give asymmetrical flexible locators 150*a* (FIG. 11). The flexible locators 150*b* can be symmetrically placed on the elongated first channel wall 64 as shown in FIG. 11A. The flexible locators 150*c* may be placed on the base surface of the elongated channel 62 as shown in FIG. 11B. In some embodiments, at least one of the elongated first and second channels 62, 66 includes one or more flexible locators 150 extending into the elongated first and second channels 62, 66 from both channel walls 64. In other embodiments, the elongated first and second channels 62, 66 each include two flexible locators 150 extending into the elongated first and second channels 62, 66 from both channel walls 64 to position the first and second edges 22, 34, respectively.

In some embodiments, the one or more extruded rails 50 and the one or more flexible locators 150 are made from a general polymeric material wherein the one or more flexible locators 150 have a lower hardness than the polymeric material making up the insulating thermal bridge 46. In other embodiments, the one or more extruded rails 50 and the one or more flexible locators 150 are each made from different general polymeric materials wherein the one or more flexible locators 150 may have an identical or lower hardness than the polymeric material making up the insulating thermal bridge 46. In some embodiments, the one or more flexible locators 150 comprise continuous strips of polymeric material (not shown) coupled along the entire length of the elongated first and second channels 62, 66 of the insulating thermal bridge 46. In other embodiments the one or more flexible locators 150 may comprise tab portions or short strips (not shown) distributed along the length of the elongated first and second channels 62, 66 of the insulating thermal bridge 46, thereby forming gaps between adjacent locators 150.

Figure 12:
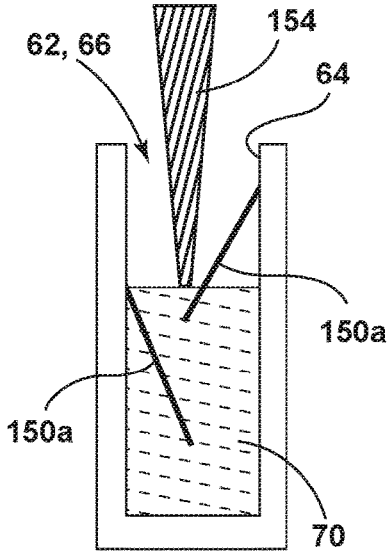
FIG. 12-12B is a partially schematic cross-sectional view of a portion of FIG. 10 having flexible locators being filled with a curable sealant according to one aspect of the present disclosure.
Figure 12A:
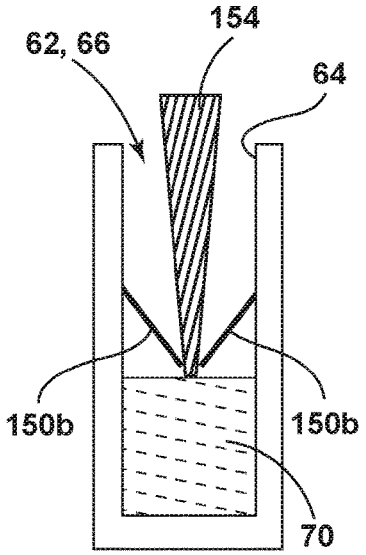
Figure 12B:
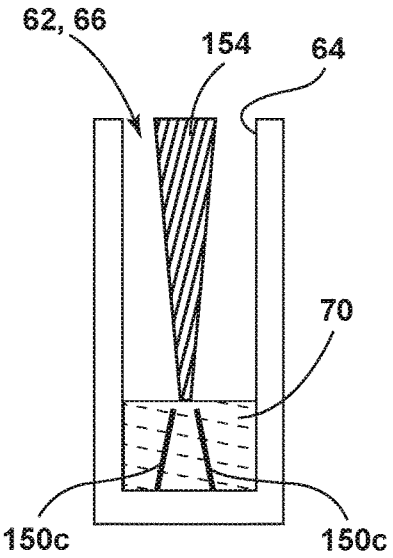

As shown in FIGS. 12-12B, during assembly an adhesive nozzle 154 may be utilized to position/deposit curable sealant 70 into elongated channel 62 and/or 66. In some embodiments, the curable sealant 70 may fill up the entire elongated channel 62 and/or 66 to the top surface, may be filled up past the flexible locators 150*a* (FIG. 12), filled up to the flexible locators 150*b* (FIG. 12A), or to any other desired level in the elongated channel 62 and/or 66 (FIG. 12B). The curable sealant 70 may be deposited/positioned in the elongated first and second channels 62, 66 before (or after) the insulating thermal bridge 46 is coupled across the gap 38.

Figure 13:
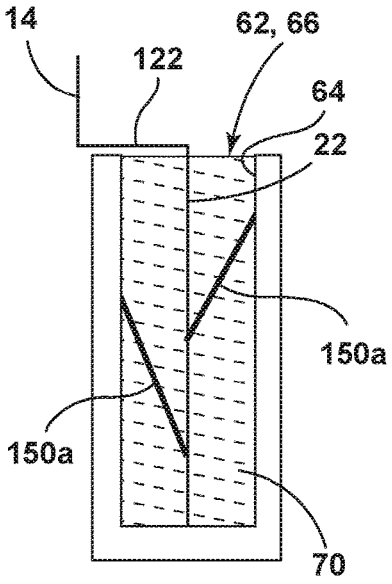
FIG. 13-13B is a partially schematic cross-sectional view of a portion of FIG. 10 having flexible locators filled with a curable sealant and a first edge of a wrapper according to one aspect of the present disclosure.
Figure 13A:
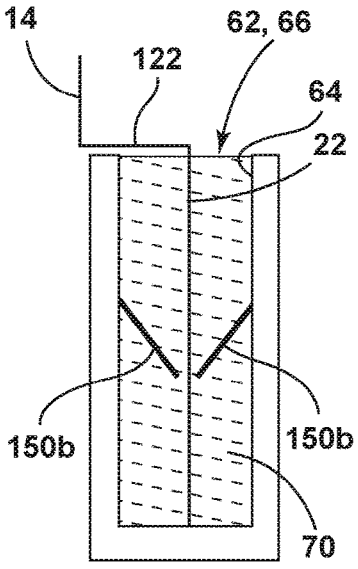
Figure 13B:
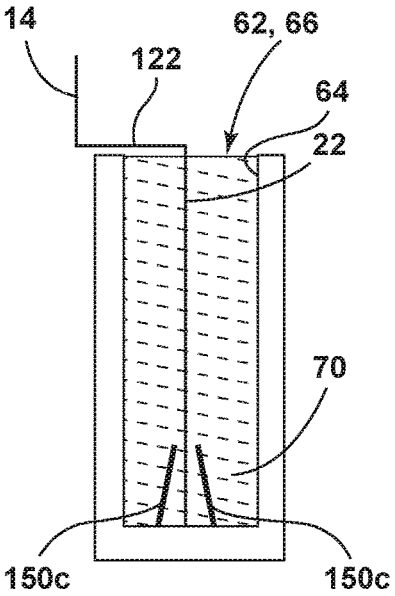

As shown in FIGS. 13-13B, after the adhesive nozzle 154 (FIG. 12) has applied/deposited the curable sealant 70 into elongated channel 62 and/or 66, the first edge 22 of the wrapper 14 is positioned in the elongated channel 62 and/or 66 with the guidance of the flexible locators 150. As shown in FIGS. 13-13B, the asymmetrical flexible locators 150*a*, the symmetrical flexible locators 150*b*, and the symmetrical base flexible locators 150*c* guide the first edge 22 of the wrapper 14 into a central position in channels 62, 66 whereby the edge 22 is spaced apart from the sidewalls of channels 62, 66. The flexible locators 150 can be co-extruded with the extruded rails 50 (FIG. 2) to form the insulating thermal bridge 46 (FIG. 2). Flexible locators 150 reduce or eliminate deflection/misdirection of the liner 26 and the wrapper 14 that could otherwise occur. The flexible nature of flexible locators 150 permits the adhesive nozzle 154 to deflect flexible locators 150 when filling the elongated channels 62 with the curable sealant 70. Curable sealant 70 wets substantially the entire surfaces of elongated channels 62, 66 to minimize/eliminate the formation of any leak paths. Flexible locators 150 may be angled such that the first and second edges 22, 34 of the wrapper 14 and liner 26, respectively, slidably engage the flexible locators 150 as the insulating thermal bridge 46 is coupled across the gap 38.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A method of making a vacuum insulated refrigerator structure, the method comprising:

forming a wrapper from a sheet of material whereby the wrapper has a first opening and a first edge extending around the first opening;

forming a liner from a sheet of material whereby the liner has a second opening and a second edge extending around the second opening;

positioning the liner inside of the wrapper with the first and second edges being spaced apart to form a gap therebetween, and to form a cavity between the wrapper and the liner;

forming an insulating thermal bridge by molding corner portions onto adjacent end portions of one or more elongated rails in an injection molding device, wherein the insulating thermal bridge includes elongated first and second channels;

positioning uncured curable sealant in the first and second channels;

inserting the first and second edges into the first and second channels, respectively, to couple the insulating thermal bridge across the gap;

causing a porous material to at least partially fill the cavity between the wrapper and the liner;

forming a vacuum in the cavity; and sealing the cavity to maintain the vacuum.

2. The method of claim 1, including:

co-extruding the one or more elongated rails to form one or more flexible locators extending from at least one channel wall into: 1) only the elongated first channel; or 2) only the elongated second channel; or 3) both the elongated first channel and the elongated second channel.

3. The method of claim 2, wherein:

the one or more elongated rails and the one or more flexible locators are co-extruded from a general polymeric material wherein the one or more flexible locators have a lower hardness.

4. The method of claim 1, wherein:

at least one of the elongated first and second channels are formed to include one or more flexible locators protruding into the elongated first and second channels from both channel walls.

5. The method of claim 1, wherein:

the elongated first and second channels are each formed to include two flexible locators protruding into the elongated first and second channels from both channel walls to position the first and second edges, respectively.

6. The method of claim 5, wherein:

the one or more flexible locators are formed to an angle such that the first and second edges of the wrapper and the liner, respectively, slidably engage the flexible locators as the insulating thermal bridge is coupled across the gap.

7. The method of claim 1, including:

positioning the curable sealant in the elongated first and second channels before the insulating thermal bridge is coupled across the gap.

8. The method of claim 1, including:

co-extruding the one or more elongated rails from a base material and a barrier material that is substantially impervious to gas.

9. The method of claim 8, wherein:

the barrier material comprises ethylene vinyl alcohol that is co-extruded from the base material.

10. A method of making a vacuum insulated refrigerator structure, the method comprising:

forming a wrapper from a sheet of material whereby the wrapper has a first opening and a first edge extending around the first opening;

forming a liner from a sheet of material whereby the liner has a second opening and a second edge extending around the second opening;

positioning the liner inside of the wrapper with the first and second edges being spaced apart to form a gap therebetween, and to form a cavity between the wrapper and the liner;

forming a plurality of rails utilizing a co-extrusion process that includes co-extruding a base material and a barrier material to form a barrier to: 1) gases alone; or 2) liquids alone; or 3) both gases and liquids taken together;

forming an insulating thermal bridge by molding corner portions to end portions of adjacent rails in an injection molding device, wherein the insulating thermal bridge includes elongated first and second channels;

coupling the insulating thermal bridge across the gap by inserting the first and second edges into the first and second channels, respectively;

positioning curable sealant in the first and second channels;

causing a porous material to at least partially fill the cavity between the wrapper and the liner;

forming a vacuum in the cavity; and sealing the cavity to maintain the vacuum.

11. The method of claim 10, wherein:

the plurality of rails are co-extruded to form one or more flexible locators extending from at least one channel wall into: 1) only the elongated first channel; or 2) only the elongated second channel; or 3) both the first elongated channel and the elongated second channel.

12. The method of claim 11, wherein:

the plurality of rails and one or more flexible locators are co-extruded from a general polymeric material wherein the one or more flexible locators have a lower hardness.

13. The method of claim 11, wherein:

at least one of the elongated first and second channels are formed to include opposed channel walls and one or more flexible locators protruding into the elongated first and second channels from each opposed channel wall.

14. The method of claim 11, wherein:

the one or more flexible locators are formed to an angle such that the first and second edges of the wrapper and the liner, respectively, slidably engage the flexible locators as the insulating thermal bridge is coupled across the gap.

15. The method of claim 10, wherein:

the curable sealant is positioned in the elongated first and second channels before the insulating thermal bridge is coupled across the gap.

16. A vacuum insulated refrigerator structure, comprising:

an outer wrapper having a first opening and a first edge extending around the first opening;

a liner having a second opening and a second edge extending around the second opening, wherein the liner is disposed inside the wrapper with the first and second edges being spaced apart to form a gap therebetween and to form a vacuum cavity between the wrapper and the liner;

an insulating thermal bridge extending across the gap, wherein the insulating thermal bridge includes elongated first and second channels, wherein at least one of the elongated first and second channels includes opposed channel walls and one or more flexible locators protruding from each opposed channel wall into: 1) only the elongated first channel; or 2) only the elongated second channel; or 3) both the elongated first channel and the elongated second channel, and wherein the first and second edges are disposed in the first and second channels, respectively;

sealant disposed in the first and second channels to seal the vacuum cavity and maintain a vacuum in the vacuum cavity; and porous material disposed in the vacuum cavity.

17. The vacuum insulated refrigerator structure of claim 16, wherein:

the one or more flexible locators are made from a general polymeric material, and wherein the one or more flexible locators have a lower hardness than the insulating thermal bridge.

18. The vacuum insulated refrigerator structure of claim 16, wherein:

the one or more flexible locators are angled such that the first and second edges of the wrapper and the liner, respectively, engage the flexible locators.

19. The vacuum insulated refrigerator structure of claim 16, wherein:

the insulating thermal bridge comprises a base material and: 1) an inner barrier material alone; or 2) an outer barrier material alone; or 3) an inner barrier material and an outer barrier material taken together, to form a barrier to gases and liquids.

20. The vacuum insulated refrigerator structure of claim 19, wherein:

the inner barrier material alone, the outer barrier material alone, or the inner barrier material and the outer barrier material taken together, comprises ethylene vinyl alcohol.

* * * * *